US006079555A

United States Patent [19]

Posson

[11] Patent Number: 6,079,555

[45] Date of Patent: Jun. 27, 2000

[54] ABSORBENT FOOD PRODUCT SUPPORT

[76] Inventor: Jean Posson, "La Source" Vieille Route de Cholet, Trementines 49340, France

[21] Appl. No.: 08/968,576

[22] Filed: Nov. 12, 1997

Related U.S. Application Data

[63] Continuation of application No. 08/397,251, filed as application No. PCT/FR93/00939, Sep. 24, 1993, abandoned.

[30] Foreign Application Priority Data

Sep. 25, 1992 [FR] France ..... 92 11626

[51] Int. Cl.[7] ..... B65D 5/40; B65D 5/56

[52] U.S. Cl. ..... 206/204; 426/124; 426/129

[58] Field of Search ..... 426/129, 113, 426/124; 206/204

[56] References Cited

U.S. PATENT DOCUMENTS

| | | | |
|---|---|---|---|
| 3,040,947 | 6/1962 | Wells et al. | 426/129 |
| 3,040,948 | 6/1962 | Wells | 426/129 |
| 3,316,102 | 4/1967 | Doll et al. | 426/129 |
| 3,468,468 | 9/1969 | Foote | 426/129 |
| 3,580,413 | 5/1971 | Quackenbush | 426/129 |
| 3,640,209 | 2/1972 | Wilson | 426/113 |
| 3,834,606 | 9/1974 | Andersson | 426/129 |
| 3,863,832 | 2/1975 | Gordon | 426/113 |
| 3,916,030 | 10/1975 | Bard et al. | 426/129 |
| 4,237,171 | 12/1980 | Laage et al. | 426/129 |
| 4,410,578 | 10/1983 | Miller | 426/129 |
| 4,533,585 | 8/1985 | Holden | 426/129 |
| 4,590,349 | 5/1986 | Brown | 426/113 |
| 4,702,377 | 10/1987 | Grone | 206/557 |
| 4,777,053 | 10/1988 | Tobelmann et al. | 426/113 |
| 4,865,855 | 9/1989 | Hansen et al. | 426/129 |
| 4,896,790 | 1/1990 | Gronnevik | 426/129 |
| 4,935,282 | 6/1990 | Pawlowski et al. | 426/129 |
| 4,940,261 | 7/1990 | Rhodes et al. | 426/129 |
| 4,949,897 | 8/1990 | Pawlak et al. | 426/129 |
| 5,093,176 | 3/1992 | Pribonic et al. | 426/129 |
| 5,096,722 | 3/1992 | Bair | 426/129 |
| 5,176,930 | 1/1993 | Kannankeril | 426/129 |
| 5,250,310 | 10/1993 | Fujino et al. | 426/129 |

FOREIGN PATENT DOCUMENTS

| | | | |
|---|---|---|---|
| 0295943 | 12/1988 | European Pat. Off. . | |
| 2655027 | 5/1991 | France . | |
| 3442341 | 5/1986 | Germany | 426/129 |
| 9109537 | 9/1991 | Germany . | |
| 1168925 | 10/1969 | United Kingdom . | |

*Primary Examiner*—Steven Weinstein
*Attorney, Agent, or Firm*—Greenblum & Bernstein, P.L.C.

[57] ABSTRACT

A support for food products includes a cardboard support on which an impermeable layer of plastic material is applied. The layer of plastic material can be of the polyethylene type, for example. The impermeable layer has perforations that provides for the absorption of exudate and any other liquid from food product support. The support advantageously can form the bottom of a liquid-tight boat-shaped tray for packaging, storing and/or displaying of meat products, such as poultry of slices of beef, for example.

15 Claims, 1 Drawing Sheet

ABSORBENT FOOD PRODUCT SUPPORT

This application is a continuation of application Ser. No. 08/397,251, filed Jun. 08, 1995, now abandoned, which is the National Stage of International Application No. PCT/FR93/00939, filed Sep. 24, 1993.

BACKGROUND OF THE INVENTION

1. Field of the Invention

This invention relates to the field of packaging. It concerns more particularly a food product support of the boat-shaped tray type with liquid-tight corners, for example, intended in particular for the packing of meat products and their packaging, storage or display for sale.

2. Background Information

This cardboard support is of the type having an impermeable contact layer in the form of a food-product polyethylene film for example. The nature of this film ensures the packaging's imperviousness. It advantageously enhances sealing, particularly at the corners, thereby preventing liquid or exudate seeping from the packaged product from staining the periphery of the packaging and its immediate external environment.

On the other hand, this enhancement of sealing limits dissipation of the product's liquid exudate. This biological liquid stagnates in the bottom of the boat-shaped tray and promotes development of bacteria. This particular aspect limits the conservation time of products and can influence their taste qualities.

To overcome this drawback, it is common practice to place on the bottom, an interpolated, free sheet made from an absorbent material of the cellulose, sponge or loofah type, compatible with and adapted to the packaged product. The absorbent material arranged between the bottom support and the product receives the released exudate and rapidly disperses and absorbs them so as to limit the risk of overflow towards the outside.

This technique is relatively efficient but calls for a preliminary operation to place the absorbent material on the support before the product is packaged. This operation generates a high material cost without overcoming the problems of bacteriological growth linked to permanent contact between the cellulose, exudate and the product.

This invention proposes a food product support of a very simple, uncomplicated structure that overcomes the aforementioned drawbacks.

This particular support is prepared in the factory and can be used as is without any additional elements. Its upper surface, in contact with the packaged product, meets the hygiene regulations currently in force. In addition, it is able to absorb liquid exudate originating from the product and thus limit the tendency of bacteria to develop.

SUMMARY OF THE INVENTION

The food product support of the invention is of the type made up of a cardboard tray or support, possibly surrounded by sides so as to form a boat-shaped tray, on which an impermeable contact layer is applied, said contact layer being made from a plastic material of the polyurethane type for example. This support is characterized in that the impermeable contact layer arranged on its upper surface comprises openings or perforations allowing the cardboard itself to absorb exudate or other liquids. The exudate released can thus be dispersed by capillary action throughout its thickness.

The plastic material impermeable layer ensures hygienic contact between the support and packaged product. It also prevents cardboard fibers from sticking to the packaged product. Furthermore, the porous qualities of the material supporting this contact layer are used in order to absorb exudate or liquids originating from the packaged product.

The perforations can be made in the impermeable contact layer of the cardboard by a stamping, shearing or puncturing operation. The depth of these perforations is included between the thickness of the contact layer and the thickness of the cardboard-layer complex. It is, preferably, substantially equal to half the thickness of the cardboard-impervious layer complex.

The shape and position of the punches used are adjusted to produce perforations that provide the best possible trade-off between good absorption of exudate from the product, the presence of maximum surface area of impermeable layer on which the product for packaging is to be placed and preservation of good rigidity of the support tray.

The perforations can be produced in several lines at the level of the edges of the support tray.

According to one particular embodiment, the perforated support forms the bottom of a liquid-tight boat-shaped tray. Thus, in addition to its hygienic qualities, the impermeable contact layer perfects the liquid-tightness at the level of the corners of the packaging. This liquid-tightness ensures that liquids or exudate are kept within the packaging, said exudate or liquids then being progressively absorbed by the cardboard support due to the presence of the perforations.

BRIEF DESCRIPTION OF THE DRAWINGS

The invention will be better understood by the following non-limiting description of a particular embodiment of the invention given for the purposes of an example and shown on the accompanying drawings. In these drawings.

DESCRIPTION OF THE PREFERRED EMBODIMENTS

As shown in the Figures, the food product support of the invention comprises a cardboard tray or support 1 whose shape and dimensions are adjusted to suit the product to be packaged. The thickness of the cardboard used can be on the order of 0.5 to 2 mm, for example.

The upper face of tray 1, on which the packaged product is to rest, is covered with an impermeable layer 2 which provides a clean, hygienic contact surface whose characteristics satisfy food product regulations currently in force.

Impermeable layer 2 is applied and/or fixed to cardboard tray 1 by any conventional technical means. It can be produced by extruding a contact film in food product polyethylene material. It can also be produced by any other liquid-proofing treatment, such as inclusion in the mass type, so as to block the fibers on the surface and prevent unwanted tearing, particularly when removing the product from the tray.

Figure 1:
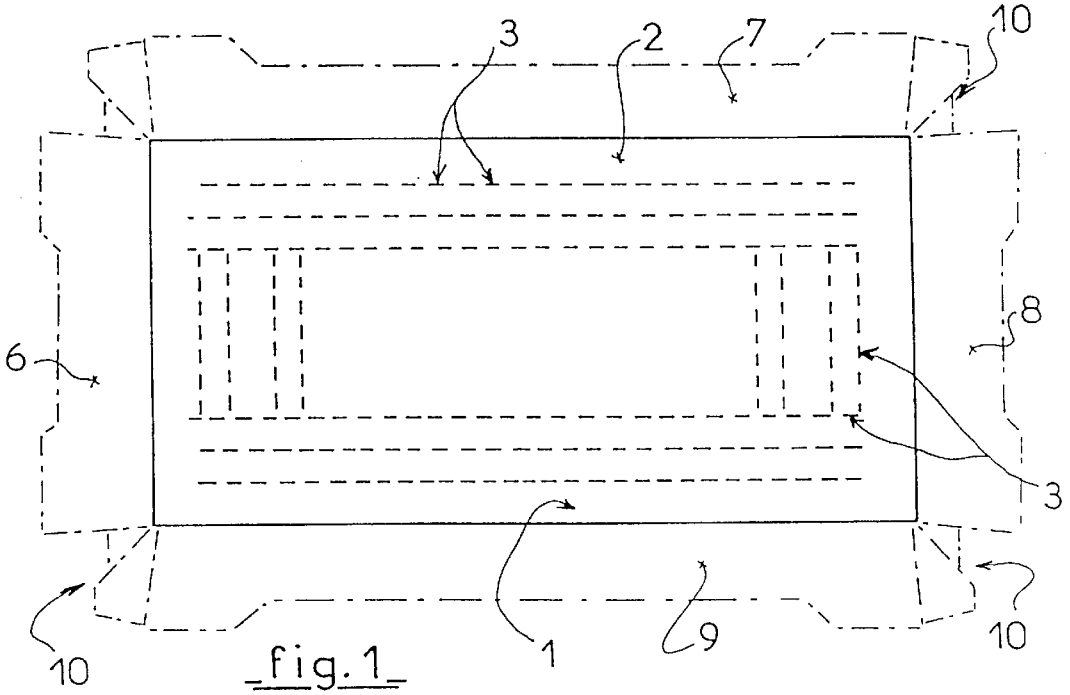
FIG. 1 is an above view of a support of the invention, integrated in a cardboard blank intended for the production of a liquid-tight boat-shaped tray. The outline of the blank is represented by the chain-dotted line.
Figure 2:
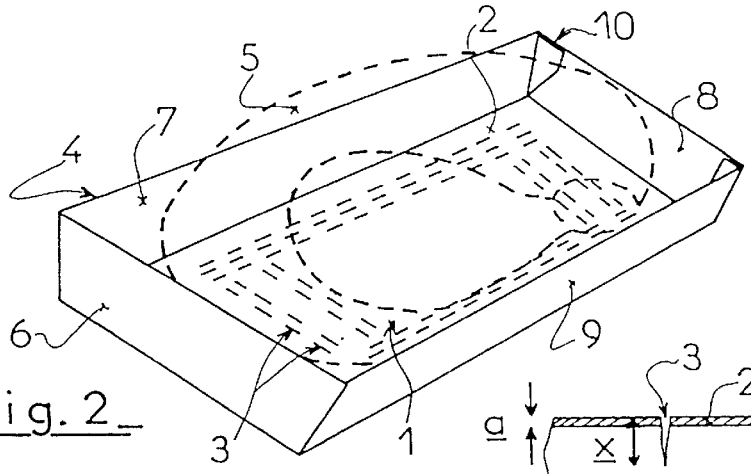
FIG. 2 is a perspective view of the erected boat-shaped tray with its perforated bottom on which the product for packaging is placed.
Figure 3:
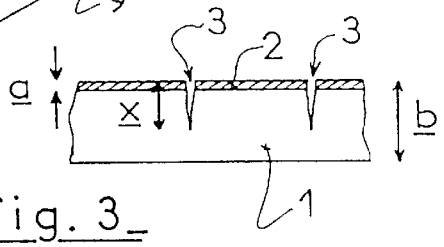
FIG. 3 is an enlarged view, in the form of a transversal section, showing the perforated support of the invention, made up of a sheet of cardboard covered by an impermeable plastic material contact layer.

FIGS. 1 to 3 show that liquid-tight layer 2 comprises a set of orifices, openings or perforations 3 whose shape and arrangement are adjusted in particular to ensure optimal absorption of moisture or liquids by cardboard tray 1.

Preferably, these perforations 3 are made after impermeable layer 2 has been applied on rigid support 1.

The impermeable layer 2-tray 1 complex is perforated at the factory when the food product support is manufactured. This operation can, for example, be carried out at the end of the line by shearing using one or more rolls equipped with suitable punches, or by stamping using cutter threads.

In FIG. 3, the depth x of perforations 3 is included between the thickness a of impermeable layer 2 and thickness b of the tray 1-layer 2 complex. This thickness x is preferably substantially equal to half the thickness b of the cardboard-impermeable layer complex to ensure that liquids penetrate into the heart of the cardboard and allow maximum absorption of released liquids or exudate.

The punches can be made up of points, cylinders or sinusoidal threads, or possibly blades defining long slots as shown in the attached figures.

Perforations 3 are distributed across the surface of the food product support in such away as to ensure absorption of exudate or liquids, wherever they may settle, and at the same time maintain correct strength and rigidity of support tray 1.

For example, perforations 3 can be arranged in lines along the edges of cardboard tray 1 at the level of the periphery limits of the product to be packaged.

According to a preferred embodiment, cardboard tray 1 can form the bottom of a boat-shaped packaging tray 4 for the packing of a product 5 represented by the dotted lines shown in FIG. 2. The general shape of tray 1 is, in this case, rectangular and is surrounded by four sides 6, 7, 8, 9, connected at the corners by fluid-tight bellows 10.

Perforations 3 can be produced in the packaging's bottom support before or after the cutting out and grooving operations, but as a rule before the boat-shaped tray is erected.

FIG. 1 shows the flat cardboard blank, and as can be seen, the long perforation lines 3 follow the four edges of tray 1. The perforation operation can be completed in a single pass on a single perforator device. A plurality of juxtaposed devices equipped with suitable perforating punches could also be used.

Once the cardboard blank has been erected, the boat-shaped tray 4 is immediately usable for packaging any food product having a certain surface dampness or likely to release biological liquids or exudate.

The food product support of the invention defines a flat, food-quality, resting surface. This surface is provided with a plurality of perforations 3 produced in the impermeable layer 2 which allow the cardboard to absorb liquids or moisture.

The surface occupied by perforations 3 is not very large and does not alter the hygienic properties of the support. The density of the perforations is chosen and adapted according to the packaged product so as to avoid prolonged contact between the product and the liquids it generates, while at the same time limiting deterioration of the packaging's immediate environment.

What is claimed:

1. A food product support for packaging, storing, and/or sales display of food product, said product support consisting essentially of:

a two layer complex of superimposed layers of material, including an upper contact layer adapted to directly support and contact the food product, said upper contact layer having a plurality of perforations for allowing exudates and other liquids originating from the food product to pass through said upper contact layer to a lower bottom support layer;

said lower bottom support layer and said upper layer forming said two-layer complex consisting essentially of said upper layer and said lower layer, said lower bottom support layer comprising a cardboard support having a predeterminate thickness and said upper contact layer being a layer made of liquid-impermeable material, said upper contact layer being superimposed on and fixed to said lower bottom support layer;

said plurality of perforations comprising a plurality of perforations extending completely through said impermeable material layer and partially penetrating into said thickness of said cardboard support for allowing the exudates and other liquids to pass through said impermeable material layer and to be absorbed into said cardboard support.

2. A food product support according to claim 1, wherein:

said two-layer complex has a predeterminate thickness;

and said perforations have a depth substantially equal to one-half of said predeterminate thickness of said two-layer complex.

3. A food product support according to claim 1, wherein:

said perforations comprise elongated slots.

4. A food product support according to claim 1, wherein:

said perforations have a cylindrical shape.

5. A food product support according to claim 1, wherein:

said perforations comprise sinusoidal slots.

6. A food product support according to claim 1, wherein:

said two-layer complex comprises a plurality of edges; and said perforations comprise a plurality of elongated slots extending along at least one of said edges of said two-layer complex.

7. A food product support according to claim 1, wherein:

said cardboard support has a predeterminate width; and said layer of impermeable material is superimposed and in contact with said cardboard support across said predeterminate width of said cardboard support, and said exudates and other liquids is absorbed by said cardboard support throughout its thickness.

8. A food product support according to claim 1, wherein:

said impermeable material comprises plastic.

9. A food product support according to claim 1, wherein:

said impermeable material comprises polyethylene.

10. A food product support according to claim 1, wherein:

said lower layer forms the bottom of a liquid-tight, boat-shaped tray.

11. The food product support of claim 1 wherein said predeterminate thickness of said cardboard support is in the range of 0.5–2 mm.

12. A food product tray for packaging, storing, and/or sales display of food product, said food product tray comprising:

a bottom and four lateral sides surrounding said bottom and connected by bellows;

said bottom consisting essentially of:

a two layer complex of superimposed layers of material, including an upper contact layer forming an interior surface of the food product tray, said upper contact layer being adapted to directly support and contact the food product, said upper contact layer having a plurality of perforations for allowing exudates and other liquids originating from the food product to pass through said upper contact layer to a lower bottom support layer;

said lower bottom support layer and said upper layer forming said two-layer complex, consisting essentially of said upper layer and said lower layer, said lower bottom support layer comprising a cardboard support having a predeterminate thickness and said upper contact layer being a layer made of a liquid-impermeable material, said upper contact layer being superimposed on and fixed to said lower layer;

said plurality of perforations comprising a plurality of perforations extending completely through said impermeable material layer and partially penetrating into said thickness of said cardboard support for allowing the exudates and other liquids to pass through said impermeable material layer and to be absorbed into said cardboard support;

said four lateral sides extending upwardly from said bottom to confer, with said bellows and said bottom, a boat-shape to the food product tray.

13. A food product tray according to claim 12, wherein:

said cardboard support has a predeterminate width; and said layer of impermeable material is superimposed and in contact with said cardboard support across said predeterminate width of said cardboard support.

14. A food product support according to claim 12, wherein:

said impermeable material comprises plastic.

15. A food product support according to claim 12, wherein:

said impermeable material comprises polyethylene.

* * * * *